US007260183B2

(12) United States Patent
Yuan et al.

(10) Patent No.: US 7,260,183 B2
(45) Date of Patent: Aug. 21, 2007

(54) FILTER AND X-RAY IMAGING DEVICE

(75) Inventors: Ping Yuan, Beijing (CN); Diansong Cao, Beijing (CN); Yuqing Li, Beijing (CN)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 0 days.

(21) Appl. No.: 11/353,622

(22) Filed: Feb. 14, 2006

(65) Prior Publication Data

US 2006/0182226 A1 Aug. 17, 2006

(30) Foreign Application Priority Data

Feb. 17, 2005 (CN) ..... 2005 1 0009074

(51) Int. Cl.
*G21K 3/00* (2006.01)

(52) U.S. Cl. ..... 378/158; 378/157

(58) Field of Classification Search ..... 378/156, 378/157, 158

See application file for complete search history.

(56) References Cited

U.S. PATENT DOCUMENTS

| | | | | |
|---|---|---|---|---|
| 4,181,858 | A * | 1/1980 | Moore | 378/18 |
| 4,247,771 | A | 1/1981 | Frevel | |
| 4,300,055 | A | 11/1981 | Taumann | |
| 4,347,440 | A | 8/1982 | Haas | |
| 5,044,002 | A * | 8/1991 | Stein | 378/54 |
| 5,107,529 | A * | 4/1992 | Boone | 378/157 |
| 5,512,754 | A | 4/1996 | Enos | |
| 5,519,223 | A * | 5/1996 | Hug et al. | 250/363.1 |
| 5,535,250 | A * | 7/1996 | Seher et al. | 378/34 |
| 6,146,854 | A | 11/2000 | Koster et al. | |
| 6,470,068 | B2 | 10/2002 | Cheng | |
| 2004/0264647 | A1 * | 12/2004 | Graf et al. | 378/157 |

FOREIGN PATENT DOCUMENTS

| | | |
|---|---|---|
| JP | 11-072619 | 3/1999 |

* cited by examiner

*Primary Examiner*—Edward J. Glick
*Assistant Examiner*—Chih-Cheng Glen Kao
(74) *Attorney, Agent, or Firm*—Armstrong Teasdale LLP

(57) ABSTRACT

In order to realize a filter that can make a fine spectrum adjustment in a wide rage and can be miniaturized, and to realize an X-ray imaging apparatus provided with the filter, a filter of the present invention is provided with plural filter plates that can form a layer crossing X-ray and adjusting means that adjusts a combination of filter plates forming the layer by individually moving the plural filter plates so as to come in and out the X-ray passing space. The plural filter plates are formed such that the thickness of each filter plate is successively doubled with the thinnest filter plate defined as a reference. The adjusting means has a pair of moving in/out mechanisms for moving, every its half number, the plural filter plates in and out from both sides of the X-ray passing space.

17 Claims, 20 Drawing Sheets

FIG. 3

| Number of Filter Plate | n | - - - 8 | 7 | 6 | 5 | 4 | 3 | 2 | 1 |
|---|---|---|---|---|---|---|---|---|---|
| Plate Max. Thickness | $AT*2^{n-1}$ | - - -$AT*2^{7}$ | $AT*2^{6}$ | $AT*2^{5}$ | $AT*2^{4}$ | $AT*2^{3}$ | $AT*2^{2}$ | $AT*2^{1}$ | $AT*2^{0}$ |
| Number of Step | $2^{n}$ | - - - $2^{8}$ | $2^{7}$ | $2^{6}$ | $2^{5}$ | $2^{4}$ | $2^{3}$ | $2^{2}$ | $2^{1}$ |
| Total Thickness | $AT*(2^{n}-1)$ | - - - $AT*2^{8}-1)$ | $AT*(2^{7}-1)$ | $AT*(2^{6}-1)$ | $AT*(2^{5}-1)$ | $AT*(2^{4}-1)$ | $AT*(2^{3}-1)$ | $AT*(2^{2}-1)$ | $AT*(2^{1}-1)$ |

FIG. 4

| STEP | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Filter Plate 161 | 0 | 1 | 0 | 1 | 0 | 1 | 0 | 1 | 0 | 1 | 0 | 1 | 0 | 1 | 0 | 1 |
| Filter Plate 162 | 0 | 0 | 1 | 1 | 0 | 0 | 1 | 1 | 0 | 0 | 1 | 1 | 0 | 0 | 1 | 1 |
| Filter Plate 163 | 0 | 0 | 0 | 0 | 1 | 1 | 1 | 1 | 0 | 0 | 0 | 0 | 1 | 1 | 1 | 1 |
| Filter Plate 164 | 0 | 0 | 0 | 0 | 0 | 0 | 0 | 0 | 1 | 1 | 1 | 1 | 1 | 1 | 1 | 1 |
| Sum of Thickness (mm) | 0 | 1 | 2 | 3 | 4 | 5 | 6 | 7 | 8 | 9 | 10 | 11 | 12 | 13 | 14 | 15 |

FIG. 14

| Number of Cam per Axis | n | ·····8 | 7 | 6 | 5 | 4 | 3 | 2 | 1 |
|---|---|---|---|---|---|---|---|---|---|
| Number of State | $2^n$ | ·····$2^8$ | $2^7$ | $2^6$ | $2^5$ | $2^4$ | $2^3$ | $2^2$ | $2^1$ |
| Step Angle | $360°/2^n$ | $360°/2^8$ | $360°/2^7$ | $360°/2^6$ | $360°/2^5$ | $360°/2^4$ | $360°/2^3$ | $360°/2^2$ | $360°/2^1$ |

FIG. 15A
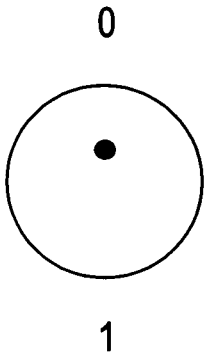
FIG. 15B
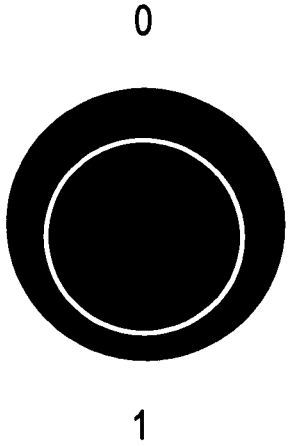
FIG. 16
| Step | | 1 | 2 |
|---|---|---|---|
| Cam | Position | 0 | 1 |
| | Angle | 0° | 180° |
FIG. 17
| Step | | 1 | 2 | 3 | 4 |
|---|---|---|---|---|---|
| Cam 1 | Position | 0 | 1 | 0 | 1 |
| | Angle | 0° | 180° | 0° | 180° |
| Cam 1' | Position | 0 | 0 | 1 | 1 |
| | Angle | 0° | | 180° | |

FIG. 18A
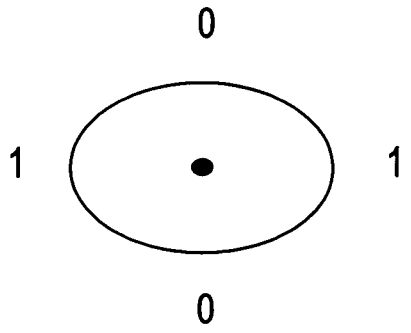
FIG. 18B
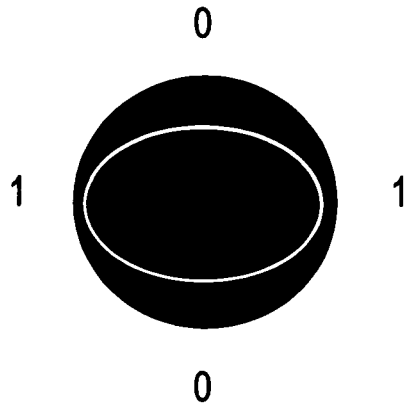
FIG. 18C
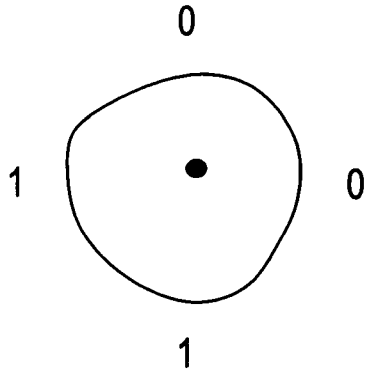
FIG. 18D
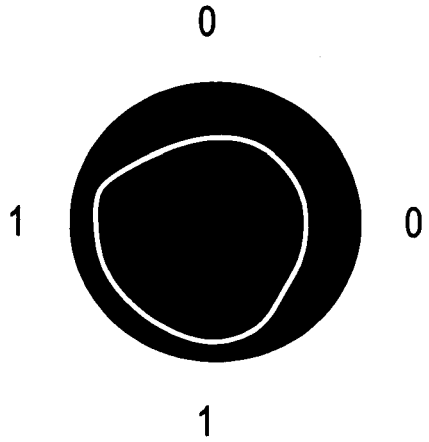
FIG. 19
| Step | | 1 | 2 | 3 | 4 |
|---|---|---|---|---|---|
| Cam 1 | Position | 0 | 1 | 0 | 1 |
| | Angle | 0° | 90° | 180° | 270° |
| Cam 2 | Position | 0 | 0 | 1 | 1 |
| | Angle | 0° | 90° | 180° | 270° |

FIG. 20

| Step | | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|
| Cam 1 | Position | 0 | 1 | 0 | 1 | 0 | 1 | 0 | 1 | 0 | 1 | 0 | 1 | 0 | 1 | 0 | 1 |
| | Angle | 0° | 90° | 180° | 270° | 0° | 90° | 180° | 270° | 0° | 90° | 180° | 270° | 0° | 90° | 180° | 270° |
| Cam 2 | Position | 0 | 0 | 1 | 1 | 0 | 0 | 1 | 1 | 0 | 0 | 1 | 1 | 0 | 0 | 1 | 1 |
| | Angle | 0° | 90° | 180° | 270° | 0° | 90° | 180° | 270° | 0° | 90° | 180° | 270° | 0° | 90° | 180° | 270° |
| Cam 1' | Position | 0 | 0 | 0 | 0 | 1 | 1 | 1 | 1 | 0 | 0 | 0 | 0 | 1 | 1 | 1 | 1 |
| | Angle | 0° | | | | 90° | | | | 180° | | | | 270° | | | |
| Cam 2' | Position | 0 | 0 | 0 | 0 | 0 | 0 | 0 | 0 | 1 | 1 | 1 | 1 | 1 | 1 | 1 | 1 |
| | Angle | 0° | | | | 90° | | | | 180° | | | | 270° | | | |

| Step | | 1 | 2 | 3 | 4 | 5 | 6 | 7 | 8 |
|---|---|---|---|---|---|---|---|---|---|
| Cam 1 | Position | 0 | 1 | 0 | 1 | 0 | 1 | 0 | 1 |
| | Angle | 0° | 45° | 90° | 135° | 180° | 225° | 270° | 315° |
| Cam 2 | Position | 0 | 0 | 1 | 1 | 0 | 0 | 1 | 1 |
| | Angle | 0° | 45° | 90° | 135° | 180° | 225° | 270° | 315° |
| Cam 3 | Position | 0 | 0 | 0 | 0 | 1 | 1 | 1 | 1 |
| | Angle | 0° | 45° | 90° | 135° | 180° | 225° | 270° | 315° |

FILTER AND X-RAY IMAGING DEVICE

CROSS REFERENCE TO RELATED APPLICATIONS

This application claims the benefit of Chinese Application No. 200510009074.2 filed Feb. 17, 2005.

BACKGROUND OF THE INVENTION

The present invention relates to a filter and an X-ray imaging apparatus, and more particularly to a filter that adjusts energy spectra of X-ray, and an X-ray imaging apparatus provided with the filter.

An X-ray imaging apparatus irradiates X-ray to a subject by adjusting energy spectra of the X-ray with a filter. The filter is provided in a collimator box attached to an X-ray tube. In order to obtain desired spectra, the filter can be used by switching plural filter plates attached to a rotating disc (e.g., see patent document 1).

[Patent Document 1] Japanese Published Unexamined Patent Application No. HEI11-76219 (p. 2, FIG. 1)

Spectra can desirably be adjusted in a wide range with close attention, but in the construction in which the filter plates are switched by the rotating disc, a four-step adjustment is about all this construction can provide. Therefore, widening the adjustment range causes a rough step, while providing more steps narrows the adjustment range. When a multi-step adjustment is made possible in the rotating disc system anyway, the rotating disc to which a great number of filters are attached is increased in size, thus unrealistic.

SUMMARY OF THE INVENTION

Therefore, an object of the present invention is to realize a filter that can make a fine spectrum adjustment in a wide rage and can be miniaturized, and to realize an X-ray imaging apparatus provided with the filter.

The invention in one aspect for solving the above-mentioned problem is a filter comprising plural filter plates that can form a layer crossing X-ray and adjusting means that adjusts a combination of filter plates forming the layer by individually moving the plural filter plates so as to come in and out the X-ray passing space.

The invention in another aspect for solving the above-mentioned problem is an X-ray imaging apparatus for imaging a subject by X-ray via a filter, wherein the filter comprises plural filter plates that can form a layer crossing X-ray and adjusting means that adjusts a combination of filter plates forming the layer by individually moving the plural filter plates so as to come in and out the X-ray passing space.

It is preferable that the plural filter plates are formed such that the thickness of each filter plate is successively doubled with the thinnest filter plate defined as a reference, from the viewpoint of performing a thickness adjustment in which the thickness of the thinnest filter plate is rendered to be the minimum step.

From the viewpoint of interleaving the filter plates from both sides, it is preferable that the adjusting means has a pair of moving in/out mechanisms for moving the plural filter plates in and out from both sides of the X-ray passing space. One of the mechanisms moves a first set made up of every other filter plate from the plural filter plates. The other of the pair of mechanisms moves a second set of filter plates made of the alternate group of every other filter plate of the remaining of the plural filter plates.

From the viewpoint of simplifying the construction, it is preferable that the moving in/out mechanism moves the filter plates in and out by a reciprocating movement of a link based upon the rotation of a plate cam.

From the viewpoint of reducing components, it is preferable that plural plate cams present at the same side with respect to the X-ray passing space have a common rotation axis.

It is preferable that the moving in/out mechanism moves the filter plates in and out by a swing movement of an arm driven by a motor for facilitating the miniaturization.

It is preferable that the moving in/out mechanism moves the filter plates in and out by using a reciprocating movement of a movable section of an electromagnetic solenoid for facilitating linear movement.

It is preferable that the moving in/out mechanism moves the filter plates in and out by using a reciprocating movement of a movable section of an air cylinder for facilitating linear movement.

It is preferable that the moving in/out mechanism moves the filter plates in and out by using a reciprocating movement of a movable section of a hydraulic cylinder for facilitating linear movement.

According to the present invention, the filter has plural filter plates that can form a layer crossing X-ray and adjusting means that adjusts a combination of filter plates forming the layer by individually moving the plural filter plates so as to come in and out the X-ray passing space, thereby being capable of realizing a filter that can provide a fine spectrum adjustment and can be miniaturized, and an X-ray imaging apparatus provided with the filter.

Further objects and advantages of the present invention will be apparent from the following description of the preferred embodiments of the invention as illustrated in the accompanying drawings.

BRIEF DESCRIPTION OF THE DRAWINGS

FIG. 3 is a view showing the maximum plate thickness, step number of increasing or decreasing thickness and total sum of the plate thickness corresponding to the number of the filter plate.

FIG. 4 is a view showing a combination of a filter plate every step.

FIG. 14 is a view showing the number of a switching state and a rotational angle step corresponding to the number of cam per axis.

FIG. 15 is a view showing a shape of a plate cam.

FIG. 16 is a view showing an advancing position or retreating position of a filter plate and a rotational angle of a cam for every step.

FIG. 17 is a view showing an advancing position or retreating position of a filter plate and a rotational angle of a cam for every step.

FIG. 18 is a view showing a shape of a plate cam.

FIG. 19 is a view showing an advancing position or retreating position of a filter plate and a rotational angle of a cam for every step.

FIG. 20 is a view showing an advancing position or retreating position of a filter plate and a rotational angle of a cam for every step.

DETAILED DESCRIPTION OF THE INVENTION

Figure 1:
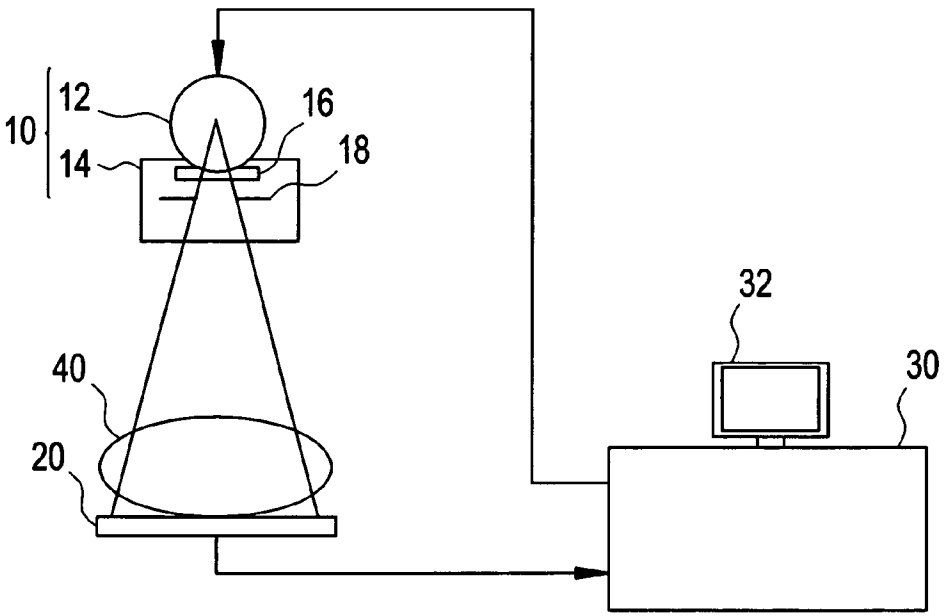
FIG. 1 is a view showing a construction of one example of an X-ray imaging apparatus according to the best mode for carrying out the invention.

A best mode for carrying out the invention will be explained hereinbelow in detail with reference to the drawings. It should be noted that the invention is not limited to the best mode for carrying out the invention. FIG. 1 shows a schematic construction of an X-ray imaging apparatus. This device is one example of the embodiment of the invention. The construction of this device represents one example of the X-ray imaging apparatus according to the embodiment of the present invention.

As shown in FIG. 1, this device has an X-ray irradiating device 10, X-ray detecting device 20 and an operator console 30. The X-ray irradiating device 10 and the X-ray detecting device oppose to each other via a subject 40.

The X-ray irradiating device 10 has an X-ray tube 12 and a collimator box 14. A filter 16 and a collimator 18 are accommodated in the collimator box 14. The filter 16 is one example of the embodiment of the present invention. The construction of this filter represents one example of the embodiment relating to the filter according to the present invention.

X-ray emitted from the X-ray tube 12 whose energy spectra are adjusted by the filter 16 is irradiated to the subject 40 through an opening of the collimator 18. The filter 16 can make the energy spectra variable. The collimator 18 has the opening that is variable.

The X-ray passing through the subject 40 is detected by the X-ray detecting device 20 to be inputted to the operator console 30. The operator console 30 reconstructs the radioscopic image of the subject based upon an inputted signal. The reconstructed radioscopic image is displayed on a display 32 of the operator console 30. The operator console 30 further controls the X-ray irradiating device 10. The control of the X-ray irradiating device 10 by the operator console 30 includes the control of the filter 16 and the control of the collimator 18. It should be noted that the filter 16 and the collimator 18 can manually be adjusted according to need.

Figure 2:
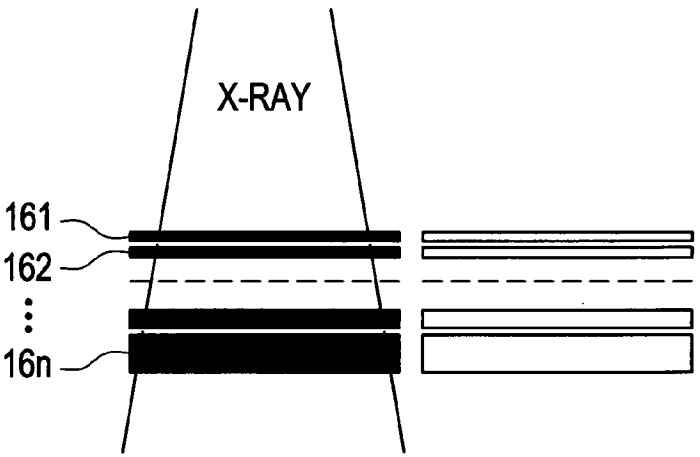
FIG. 2 is a view showing a principle construction of a filter.

The filter 16 will be explained. FIG. 2 shows a principle view of the filter 16. As shown in this figure, the filter 16 is composed of plural filter plates 161, 162 . . . 16*n*. The filter plates 161, 162 . . . 16*n* are one example of the filter plates in the present invention.

These filter plates 161, 162 . . . 16*n* form a layer crossing the X-ray. Each filter plate 16*i* (i: 1, 2 . . . n) is a formation component of the layer, and is a plate such as a metal or plastics. Each filter plate 16*i* can individually advance into or retreat from the space where the X-ray passes. In this figure, the advancing state into the X-ray passing space is shown by black-painted section while the retreating state from the X-ray passing space is shown by white sections.

The filter plates 161, 162 . . . 16*n* are formed such that the thickness of each filter plate is successively doubled with the thinnest filter plate 161 defined as a reference. Specifically, supposing that the thickness of the filter plate 161 is defined as AT, each of the filter plates 161, 162 . . . 16*n* has a thickness of AT, AT*2 . . . AT*$2^{n-1}$.

Since the filter plates 161, 162 . . . 16*n* has such thickness, selecting the combination of the filter plates relating to the formation of the layer can increase or decrease the sum of the thickness of the filter plates in the layer from 0 to AT*$2^{n-1}$ at intervals of AT with $2^n$ step.

FIG. 3 shows the maximum plate thickness, step number of increasing or decreasing thickness and total sum of the plate thickness corresponding to the number n of the filter plate. From this figure, it is understood that, when the filter plate number is 4, for example, the maximum plate thickness is AT*8, step number of increasing or decreasing thickness is 16 and the total sum of the plate thickness is AT*15.

FIG. 4 is a view showing this state in detail. In this figure, AT is 1 mm, for example. In the same figure, "1" represents the advancing state of the filter plate into the X-ray passing space, while "0" represents the retreating state. As shown in this figure, the sum of the thickness of the filter plate can be increased or decreased by 1 mm over 16 steps from 0 mm to 15 mm. This can be said to be substantially continuous thickness adjustment. Specifically, a filter can be obtained that can provide a fine spectrum adjustment over a wide range. Further, the filter layer is formed by the combination of plural filter plates, thereby facilitating miniaturization.

Figure 5:
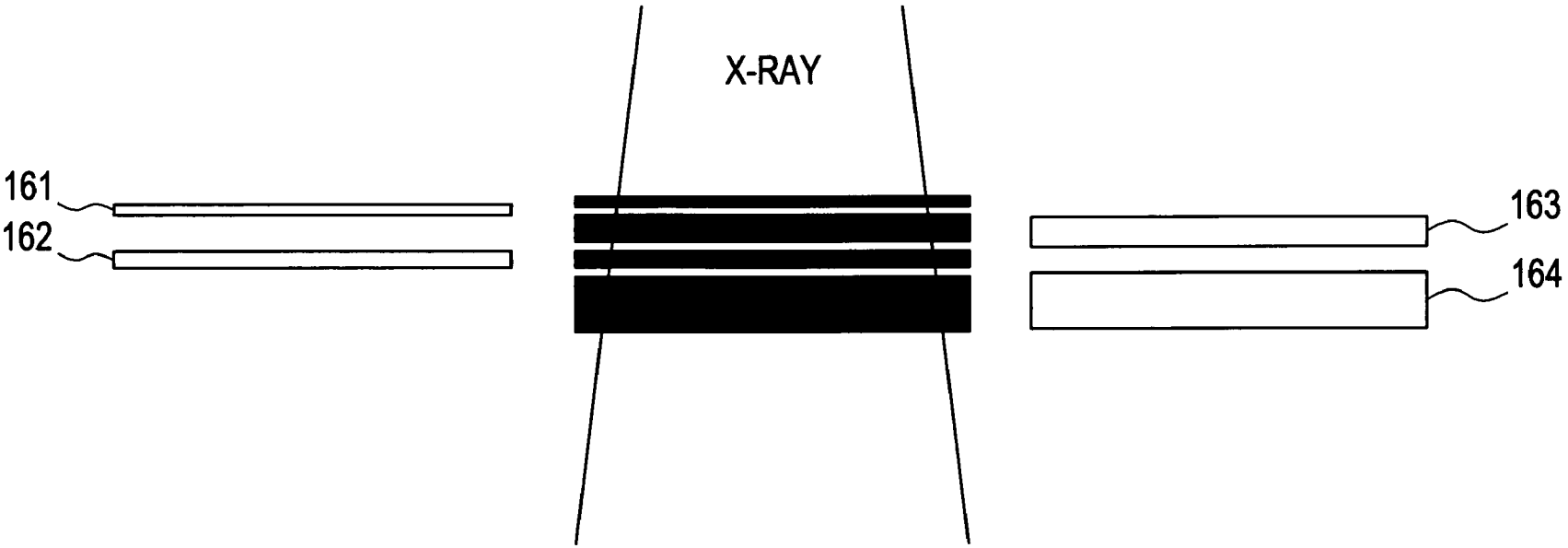
FIG. 5 is a view showing an advancing state or retreating state of the filter plate.

In the actual filter, four filter plates advance or retreat alternately from both sides of the X-ray passing space as shown in FIG. 5. Specifically, the filter plates 161 and 162 advance or retreat from the left side of the X-ray passing space, while the filter plates 163 and 164 advance or retreat from the right side of the X-ray passing space, for example. With the state where the layer is formed, the filter plates 161 and 162 at the left side and the filter plates 163 and 164 at the right side are interleaved. It should be noted that the interleave is not essential. The filter plates 163 and 164 at the right side may be on the filter plates 161 and 162 at the left side, or vice versa.

Figure 6:
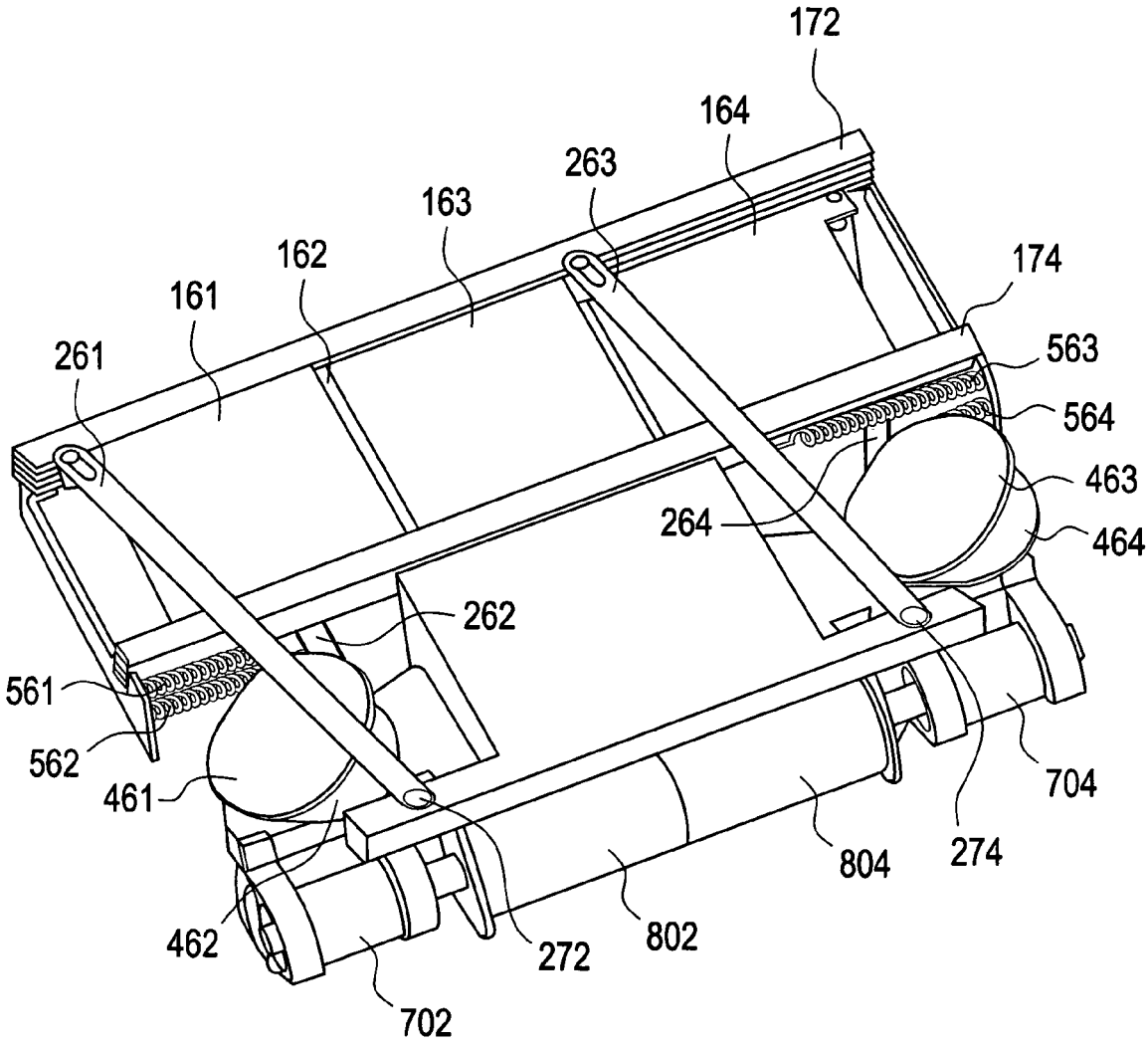
FIG. 6 is a view showing one example of a whole construction of the filter.
Figure 7:
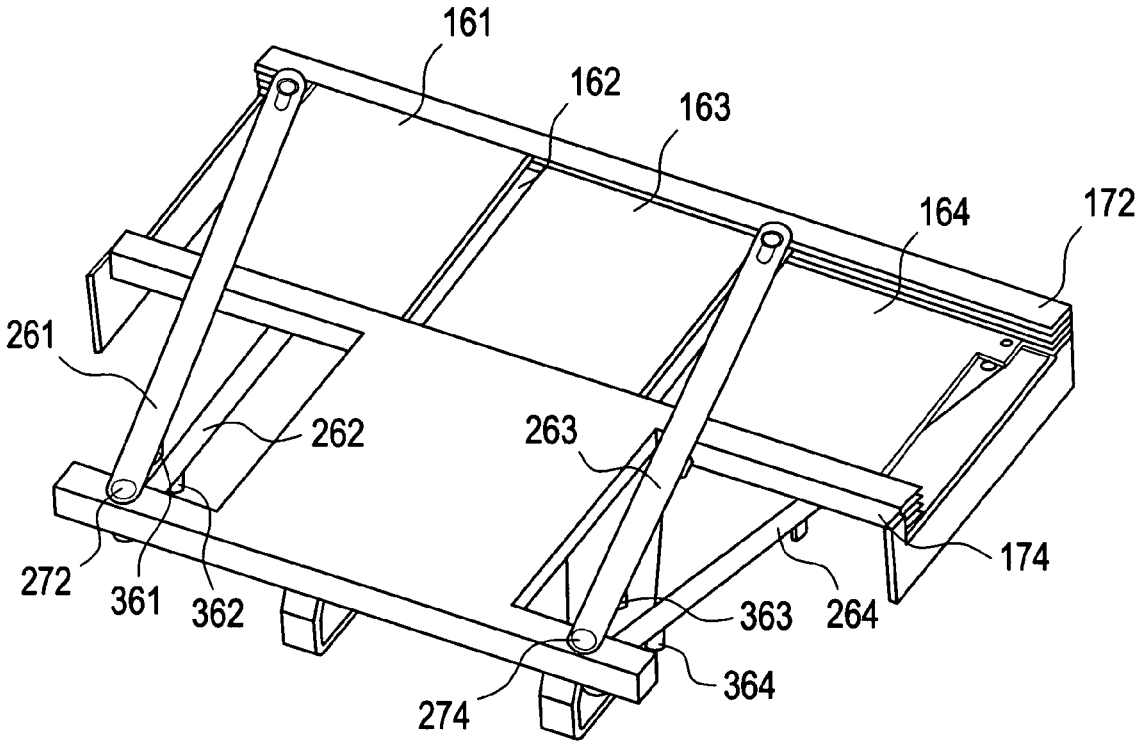
FIG. 7 is a view showing one example of a partial construction of the filter.
Figure 8:
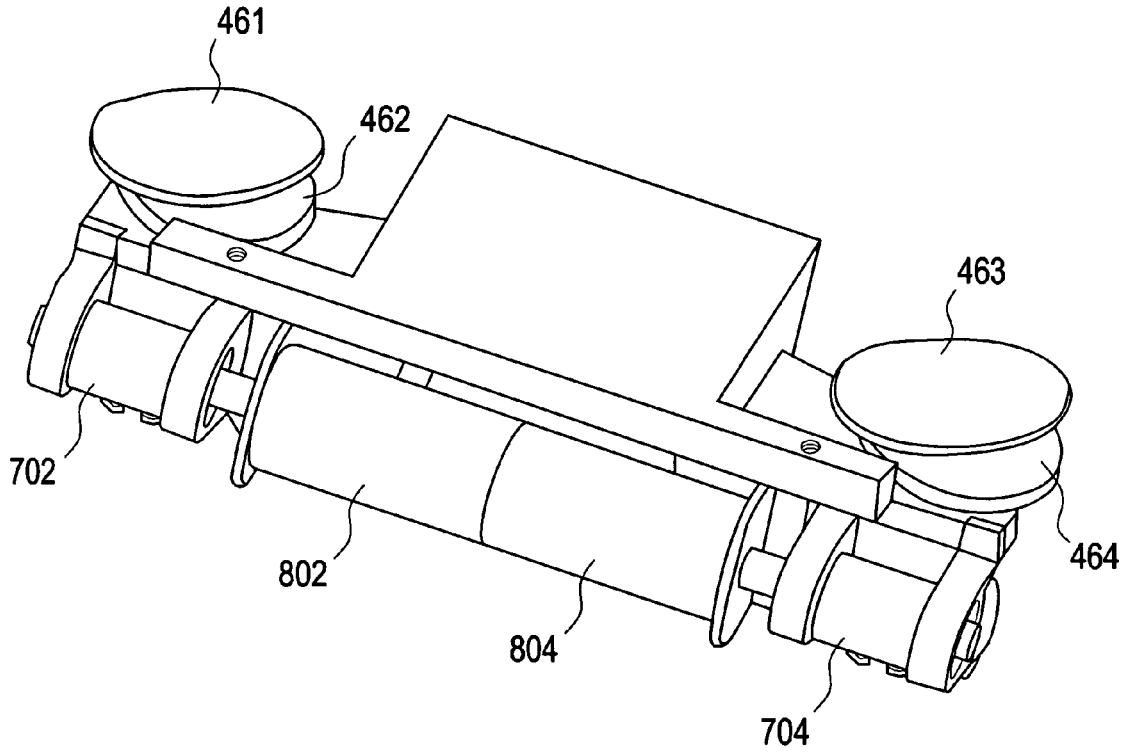
FIG. 8 is a view showing one example of a partial construction of the filter.
Figure 9:
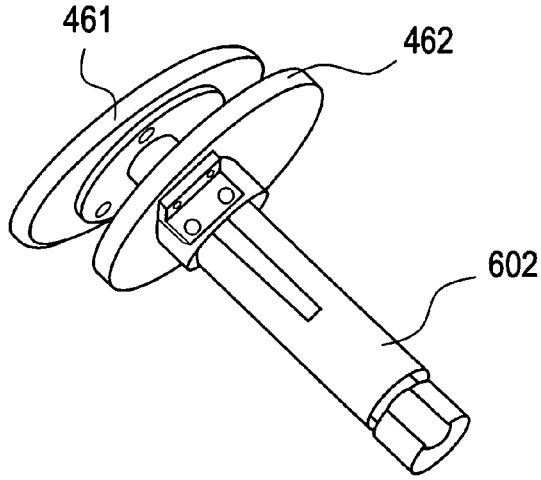
FIG. 9 is a view showing two plate cams that have a common rotating axis.

FIGS. 6 to 8 show one example of the construction of the filter 16. FIG. 6 is a whole constructional view, and FIGS. 7 and 8 are partial constructional views. As shown in these figures, four filter plates 161, 162, 163 and 164 are supported by a pair of rails 172 and 174 in the filter 16. The rails 172 and 174 are parallel to each other. The rails 172 and 174 each has four parallel grooves corresponding to four filter plates 161, 162, 163 and 164. The filter plates 161, 162, 163 and 164 are supported in such a manner that both end sections of each filter plate are inserted into each of four grooves.

The filter plates 161, 162, 163 and 164 are respectively connected to one end of links 261, 262, 263 and 264. The other end of each of the links 261 and 262 is mounted to an axis 272 so as to be rotatable about the axis 272. The other end of the links 263 and 264 is mounted to an axis 274 so as to be rotatable about the axis 274.

Plate cams 461, 462, 463 and 464 for driving the links 261, 262, 263 and 264 are respectively mounted corresponding to these links. The plate cams 461, 462, 463 and 464 are cams utilizing the outer peripheral shape. The cam of this type is referred to as a peripheral cam hereinbelow.

Each of the links 261, 262, 263 and 264 has each of pins 361, 362, 363 and 364 that come in contact with the outer periphery of each of the plate cams 461, 462, 463 and 464. These pins are always pressed toward the outer periphery of each of the plate cams 461, 462, 463 and 464 by springs 561 and 562 that pull the links 261 and 262 in the leftward direction and springs 563 and 564 that pull the links 263 and 264 in the rightward direction.

The plate cams 461 and 462 are mounted to the same rotating axis 602. This rotating axis 602 is driven by a motor 802 via a decelerator 702. The plate cams 463 and 464 are similarly mounted to the same rotating axis. This rotating axis is driven by a motor 804 via a decelerator 704. As described above, the plate cams present at the same side with respect to the X-ray passing space have a common rotation axis, thereby being capable of reducing the number of components.

The links 261 and 262 driven by the plate cams 461 and 462 displace reciprocatingly the filter plates 161 and 162 respectively along the rails 172 and 174. The filter plates 161 and 162 are in the advancing state into the X-ray passing space when they are present at the center of the rails 172 and 174, while they are in the retreating state when they are present at the left end section.

The links 263 and 264 driven by the plate cams 463 and 464 displace reciprocatingly the filter plates 163 and 164 respectively along the rails 172 and 174. The filter plates 163 and 164 are in the advancing state into the X-ray passing space when they are present at the center of the rails 172 and 174, while they are in the retreating state when they are present at the right end section.

The section composed of the links 261 to 264, plate cams 461 to 464, decelerators 702 and 704 and motors 802 and 804 is one example of the adjusting means in the present invention. The section composed of the links 261 and 262, plate cams 461 and 462, decelerator 702 and motor 802 and the section composed of the links 263 and 264, plate cams 463 and 464, decelerator 704 and motor 804 are one example of a pair of moving in/out mechanism in the present invention. The moving in/out mechanism has a construction for moving the filter plates in and out by the reciprocating movement of the links based upon the rotation of the plate cams, thereby being capable of simplifying the mechanism.

Figure 10:
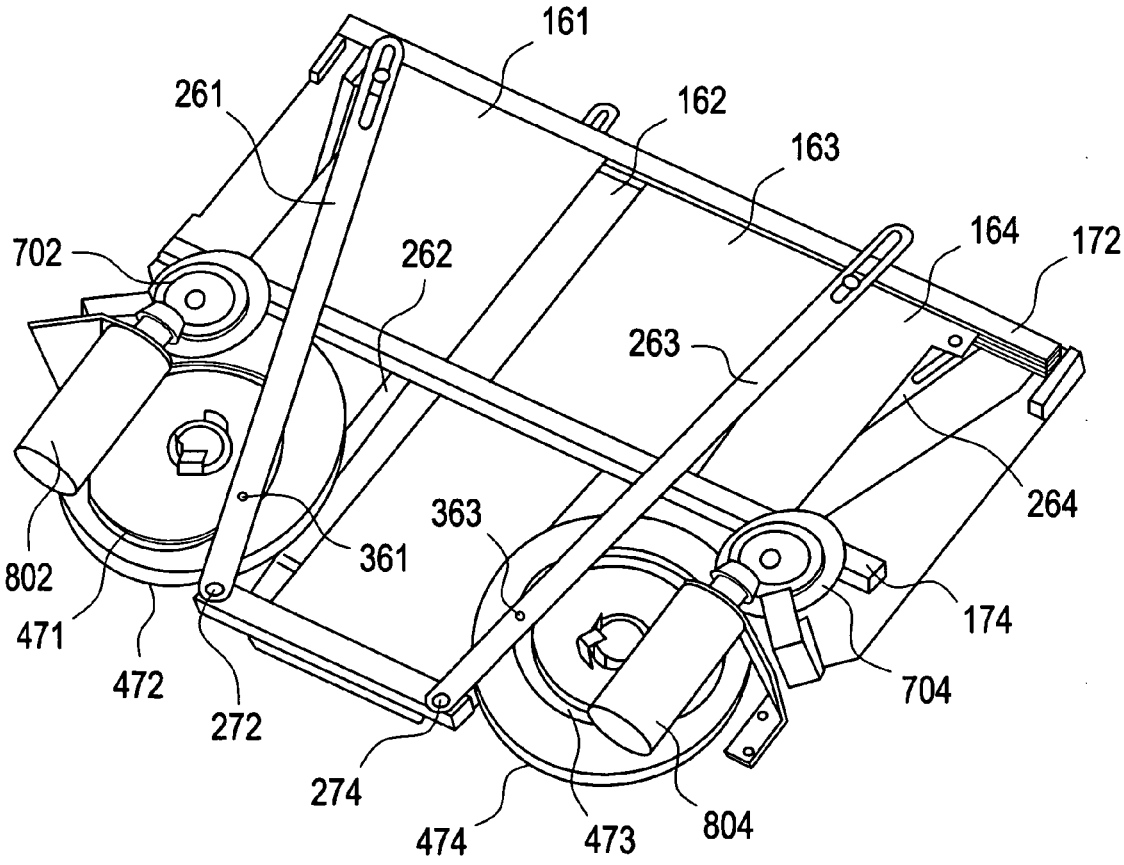
FIG. 10 is a view showing another example of a whole construction of the filter.
Figure 11:
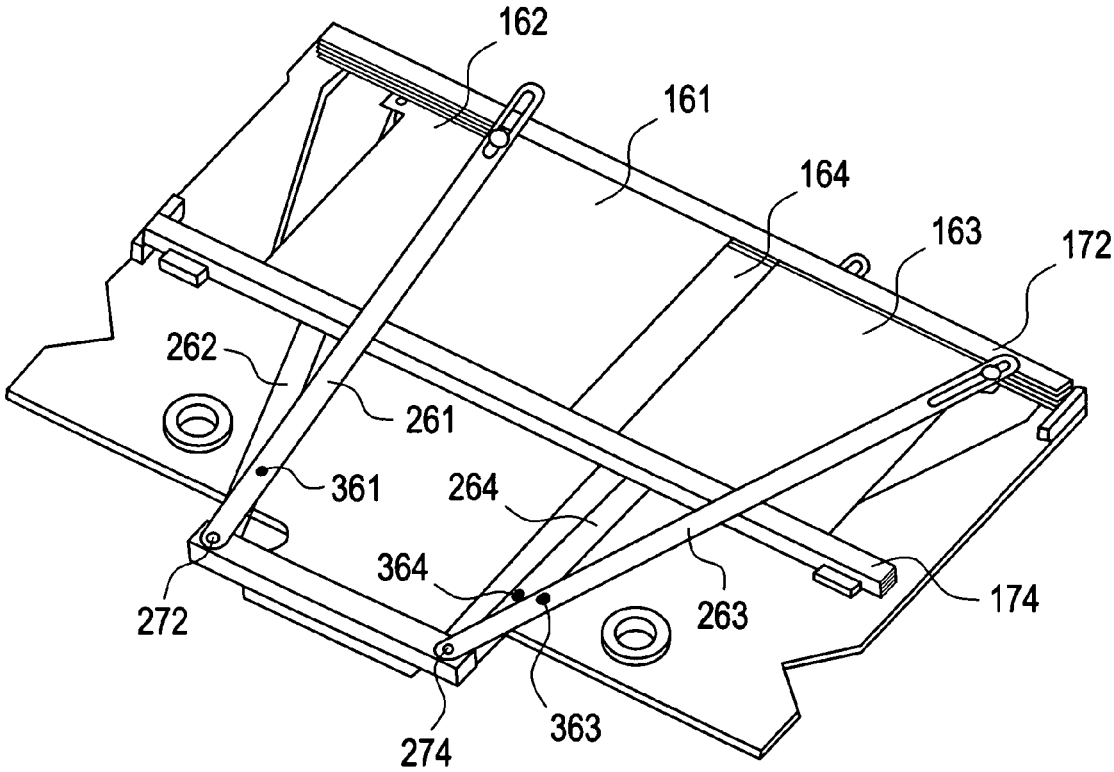
FIG. 11 is a view showing another example of a partial construction of the filter.
Figure 12:
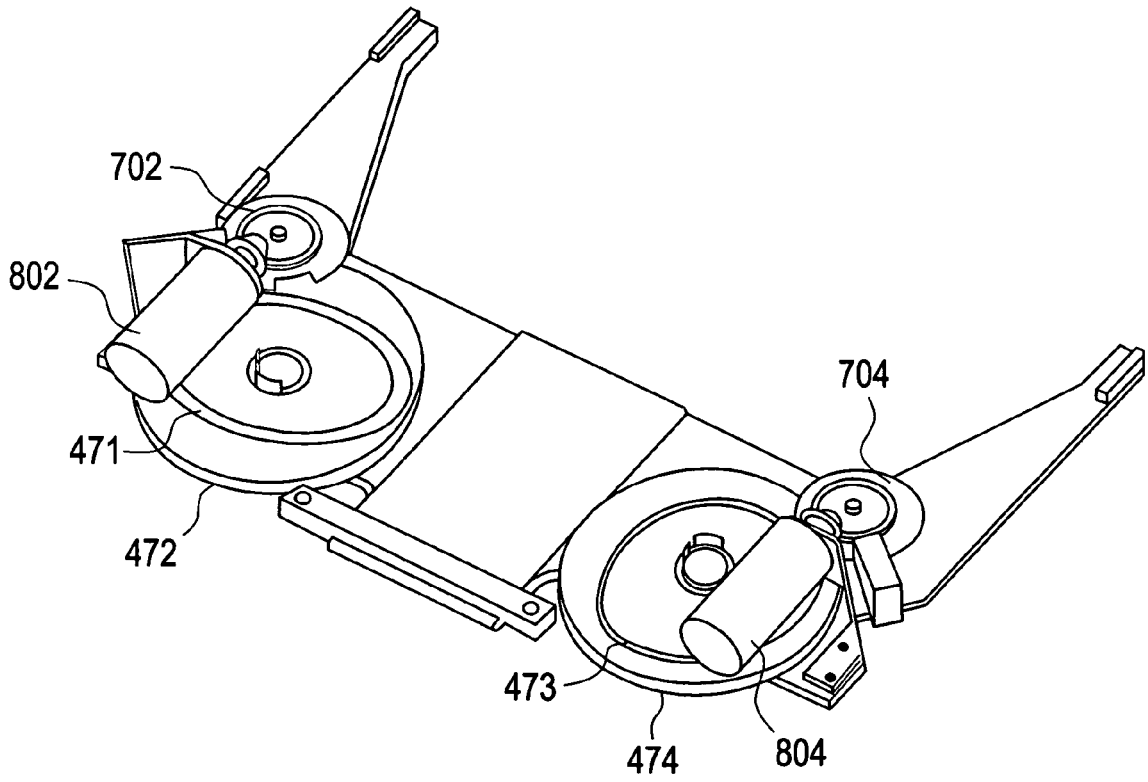
FIG. 12 is a view showing another example of a partial construction of the filter.

FIGS. 10 to 12 show one example of another construction of the filter 16. FIG. 10 is a whole constructional view, and FIGS. 11 and 12 are partial constructional views. As shown in these figures, four filter plates 161, 162, 163 and 164 are supported by a pair of rails 172 and 174 in the filter 16. The rails 172 and 174 are parallel to each other. The rails 172 and 174 each has four parallel grooves corresponding to four filter plates 161, 162, 163 and 164. The filter plates 161, 162, 163 and 164 are supported in such a manner that both end sections of each filter plate are inserted into each of four grooves.

The filter plates 161, 162, 163 and 164 are respectively connected to one end of links 261, 262, 263 and 264. The other end of each of the links 261 and 262 is mounted to an axis 272 so as to be rotatable about the axis 272. The other end of the links 263 and 264 is mounted to an axis 274 so as to be rotatable about the axis 274.

Plate cams 471, 472, 473 and 474 for driving the links 261, 262, 263 and 264 are respectively mounted corresponding to these links. Each of the links 261, 262, 263 and 264 has each of pins 361, 362, 363 and 364 that is engaged with each of the plate cams 471, 472, 473 and 474. The plate cams 471, 472, 473 and 474 are cams utilizing a loop shape drawn by a groove. The cam of this type is referred to as a grooved cam hereinbelow.

Figure 13:
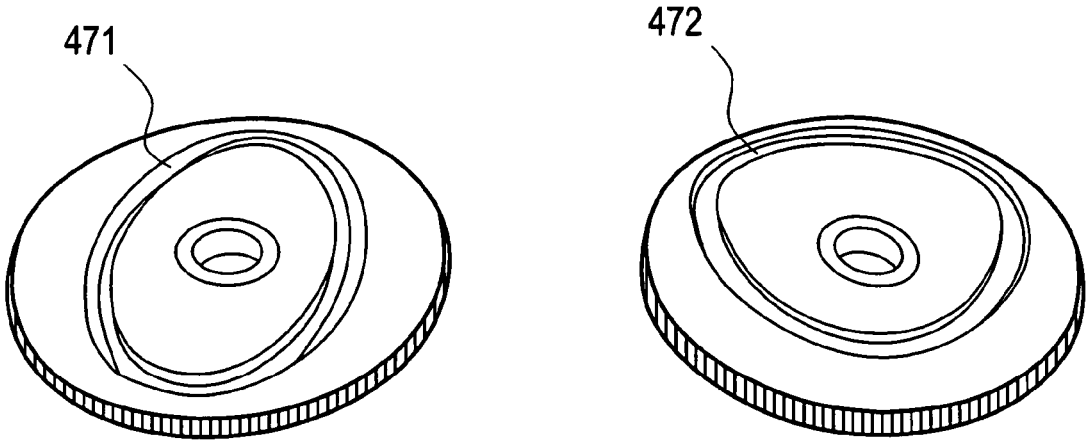
FIG. 13 is a view showing two plate cams that have a common gear.
Figure 21A:
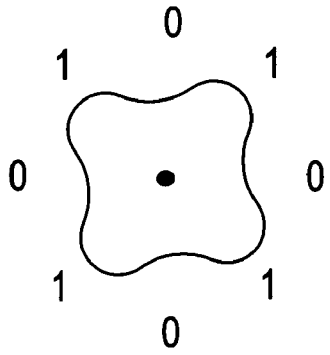
FIG. 21 is a view showing a shape of a plate cam.
Figure 21B:
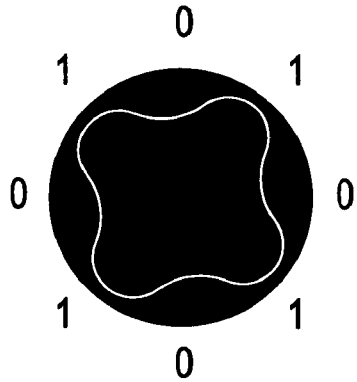
Figure 21C:
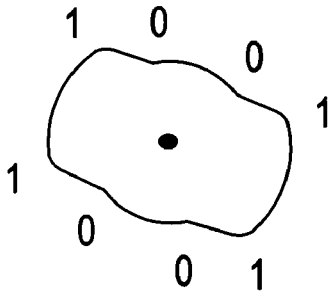
Figure 21D:
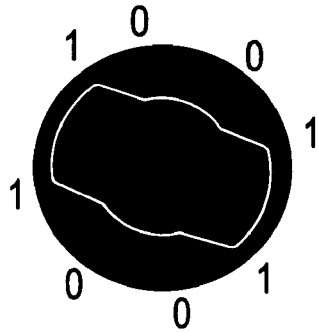
Figure 21E:
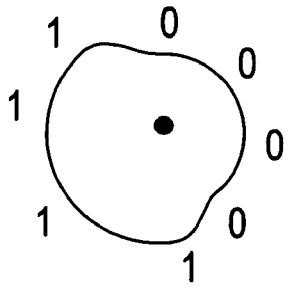
Figure 21F:
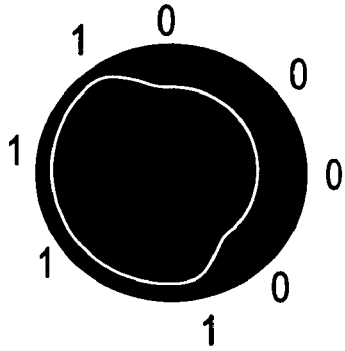

The plate cams 471 and 472 are grooves formed on both faces of a gear as shown in FIG. 13. The plate cams 471 and 472 are driven by a motor 802 via a decelerator 702. The plate cams 473 and 474 are similarly driven by a motor 804 via a decelerator 704. As described above, the plate cams present at the same side with respect to the X-ray passing space have a common gear, thereby being capable of reducing the number of components.

The links 261 and 262 driven by the plate cams 471 and 472 displace reciprocatingly the filter plates 161 and 162 respectively along the rails 172 and 174. The filter plates 161 and 162 are in the advancing state into the X-ray passing space when they are present at the center of the rails 172 and 174, while the filter plates 161 and 162 are in the retreating state when they are present at the left end section.

The links 263 and 264 driven by the plate cams 473 and 474 displace reciprocatingly the filter plates 163 and 164 respectively along the rails 172 and 174. The filter plates 163 and 164 are in the advancing state into the X-ray passing space when they are present at the center of the rails 172 and 174, while the filter plates 163 and 164 are in the retreating state when they are present at the right end section.

The section composed of the links 261 to 264, plate cams 471 to 474, decelerators 702 and 704 and motors 802 and 804 is one example of the adjusting means in the present invention. The section composed of the links 261 and 262, plate cams 471 and 472, decelerator 702 and motor 802 and the section composed of the links 263 and 264, plate cams 473 and 474, decelerator 704 and motor 804 are one example of a pair of moving in/out mechanism in the present invention. The moving in/out mechanism has a construction for moving the filter plates in and out by the reciprocating movement of the links based upon the rotation of the plate cams, thereby being capable of simplifying the mechanism.

The cam will be explained. As described above, the cam has a function for binarily switching the position of the filter plate by its rotation, between the advancing position into the X-ray passing space and the retreating position therefrom.

FIG. 14 shows the number of state that can be switched for one rotation and a rotational angle step per one switch corresponding to the number of cam per one axis. As shown in this figure, when the number of cam per one axis is n, the number of state that can be switched for one rotation is $2^n$ and the rotational angle step per one switch is $360°/2^n$.

Accordingly, when the number of cam per one axis is 1, the number of state that can be switched is 2 and the rotational angle step per one switch is 180°. When the number of cam per one axis is 2, the number of state that can be switched is 4 and the rotational angle step per one switch is 90°. When the number of cam per one axis is 3, the number of state that can be switched is 8 and the rotational angle step per one switch is 45°.

FIG. 15 shows a shape of the cam when the number of cam per one axis is 1. FIG. 15(*a*) shows the shape of the peripheral cam, while FIG. 15(*b*) shows the shape of the grooved cam. As shown in the same figure, the section at 0° becomes a short diameter "0" and the section at 180° becomes a long diameter of "1" in this cam. Accordingly, one rotation of this cam can switch the position of one filter plate between two stages, i.e., between "0" that is the retreating state and "1" that is the advancing state. FIG. 16 shows the position of the filter plate and the rotational angle of the cam corresponding to each switching step.

The cam of this shape can be used for the case where two filter plates are separated into one each, each of which is arranged at both sides of the X-ray passing space from which each of filter plates advances or retreats. The shapes of the cams at both sides are the same. It should be noted that the ratio of the rotation of cams at both sides is defined as 1:0.5, wherein the cam at the other side (cam 1') rotates at 180° every time the cam at one side (cam 1) makes one rotation. Further, the cam 1switches the position of the filter plate having the thickness of 1 and the cam 1' switches the position of the filter plate having the thickness of 2. It should be noted that the thickness here means a thickness normalized by the minimum thickness. The same is applied to the following description.

FIG. 17 shows the position of the filter plate and the rotational angle of the cam corresponding to each switching step with this state. In the same figure, "0" represents the retreating position of the filter plate, while "1" represents the advancing position of the filter plate. As shown in the same figure, a two-layer filter can be obtained in which the thickness is changed from 0 to 3 by 1 in four steps.

FIG. 18 shows a shape of the cam when the number of cam per one axis is 2. FIGS. 18(*a*) and 18(*b*) respectively show the shape of the peripheral cam and the shape of the grooved cam with respect to one (cam 1) of two cams. In this cam, the sections of 0°, 90°, 180° and 270° become short diameter "0", long diameter "1", short diameter "0" and long diameter "1" respectively, as shown in the same figure. Accordingly, one rotation of this cam can switch the position of the filter plate in a four-step manner of 0, 1, 0 and 1. An advancing position or retreating position of a filter plate and a rotational angle of a cam for every step is shown in FIG. 19.

FIGS. 18(*c*) and 18(*d*) respectively show the shape of the peripheral cam and the shape of the grooved cam with respect to the other (cam 2) of two cams. In this cam, the sections of 0°, 90°, 180° and 270° become short diameter "0", short diameter "0", long diameter "1" and long diameter "1" respectively. Accordingly, one rotation of this cam can switch the position of the filter plate in a two-step manner of 0, 0, 1 and 1.

The cam of this shape can be used for the case where four filter plates are separated into two filter plates each, and each is respectively arranged at both sides of the X-ray passing space from which each advances or retreats. The shapes of the cams at both sides are the same. It should be noted that the ratio of the rotation of cams at both sides is defined as 1:0.25, wherein the cam at the other side (cam 1' 2') rotates at 90° every time the cam at one side (cam 1, 2) makes one rotation. Further, the cam 1 or 2 switches the position of the filter plate having the thickness of 1 or 2 and the cam 1' or 2' switches the position of the filter plate having the thickness of 4 or 8.

FIG. 20 shows the position of the filter plate and the rotational angle of the cam corresponding to each switching step with this state. In the same figure, "0" represents the retreating position of the filter plate, while "1" represents the advancing position of the filter plate. As shown in the same figure, a four-layer filter can be obtained in which the thickness is changed from 0 to 15 by 1 in sixteen steps.

FIG. 21 shows a shape of the cam when the number of cam per one axis is 3. FIGS. 21(*a*) and 21(*b*) respectively show the shape of the peripheral cam and the shape of the grooved cam with respect to the first cam (cam 1) of three cams. As shown in the same figure, the sections of 0°, 45°, 90°, 135°, 180°, 225°, 270° and 315° become short diameter "0", long diameter "1", short diameter "0", long diameter "1", short diameter "0", long diameter "1", short diameter "0" and long diameter "1" respectively in this cam. Accordingly, one rotation of this cam can switch the position of the filter plate in eight-step manner of 0, 1, 0, 1, 0, 1, 0 and 1.

FIGS. 21(*c*) and 21(*d*) respectively show the shape of the peripheral cam and the shape of the grooved cam with respect to the second cam (cam 2) of three cams. As shown in the same figure, the sections of 0°, 45°, 90°, 135°, 180°, 225°, 270° and 315° become short diameter "0", short diameter "0", long diameter "1", long diameter "1", short diameter "0", short diameter "0", long diameter "1" and long diameter "1" respectively in this cam. Accordingly, one rotation of this cam can switch the position of the filter plate in four-step manner of 0, 0, 1, 1, 0, 0, 1 and 1.

Figures 22, 23:
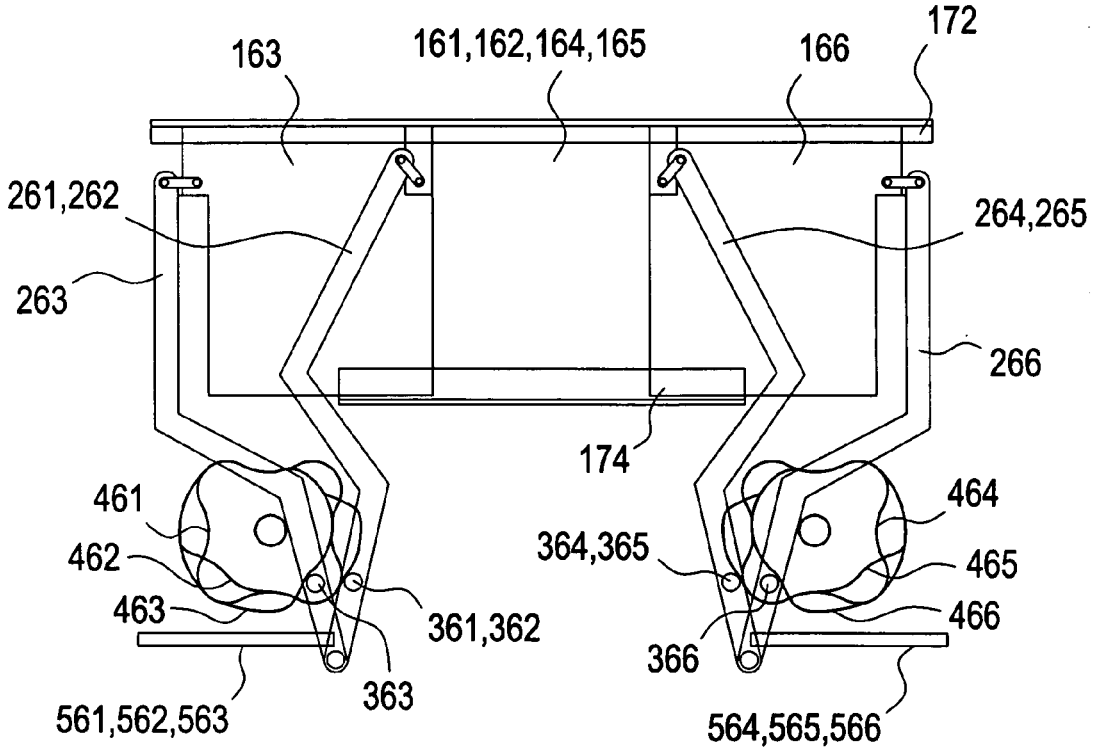
FIG. 22 is a view showing an advancing position or retreating position of a filter plate and a rotational angle of a cam for every step.
FIG. 23 is a view showing an example of main parts of a six layers filter.

FIGS. 21(*e*) and 21(*f*) respectively show the shape of the peripheral cam and the shape of the grooved cam with respect to the third cam (cam 3) of three cams. As shown in the same figure, the sections of 0°, 45°, 90°, 135°, 180°, 225°, 270° and 315° become short diameter "0", short diameter "0", short diameter "0", short diameter "0", long diameter "1", long diameter "1", long diameter "1" and long diameter "1" respectively in this cam. Accordingly, one rotation of this cam can switch the position of the filter plate in two-step manner of 0, 0, 0, 0, 1, 1, 1 and 1. FIG. 22 shows the position of the filter plate and the rotational angle of the cam corresponding to each switching step.

The cam of this shape can be used for the case where six filter plates are separated into three filter plates each, and each is respectively arranged at both sides of the X-ray passing space from which each advances or retreats. The shapes of the cams at both sides are the same. It should be noted that the ratio of the rotation of cams at both sides is defined as 1:0.125, wherein the cam at the other side (cam 1' 2', 3') rotates at 45°every time the cam at one side (cam 1, 2, 3) makes one rotation. Further, the cam 1, 2 or 3 switches the position of three filter plates each having the thickness of 1, 2 or 4 and the cam 1', 2' or 3' switches the position of three filter plates each having the thickness of 8, 16 or 32. This makes it possible to obtain a six-layer filter wherein the thickness is changed from 0 to 63 by 1 in sixty-four steps.

An example of main parts of a six layers filter is shown in FIG. 23 of a perspective. As shown in FIG. 23, the six layers filter has six filter plates 161, 162, 163, 164, 165, 166. These filter plates are supported by a pair of rails 172, 174 and can move along the rails without mutual interference.

In FIG. 23, the four filter plates 161, 162, 164, 165 out of the six plates advance in X-ray passing space and the other two filter plates 163, 166 retreat from the X-ray passing space. The filter plates 161, 162, 163 come in and out from the left side in the FIG. 23 and the filter plates 164, 165, 166 come in and out from the right side in the FIG. 23.

The filter plates 161, 162, 163 come in and out by means of links 261, 262, 263 respectively. The links 261, 262, 263 are driven by means of plate cams 461, 462, 463 respectively and turn round on a common axis 272. The plate cams 461, 462, 463 are fixed on a common rotation axis 602.

The plate cams 461, 462, 463 are connected with the links 261, 262, 263 by means of pins 361, 362, 363 respectively. The plate cams 461, 462, 463 are cams shaped like a disk, and the pins 361, 362, 363 are forced into edges of the cams by springs 561, 562, 563. Incidentally, if the plate cams 461, 462, 463 are cams having a groove instead of the cams shaped like a disk, the springs 561, 562, 563 are needless.

The filter plates 164, 165, 166 come in and out by means of links 264, 265, 266 respectively. The links 264, 265, 266 are driven by means of plate cams 464, 465, 466 respectively and turn round on a common axis 274. The plate cams 464, 465, 466 are fixed on a common rotation axis 604.

The plate cams 464, 465, 466 are connected with the links 264, 265, 266 by means of pins 364, 365, 366 respectively. The plate cams 464, 465, 466 are cams shaped like a disk, and the pins 364, 365, 366 are forced into edges of the cams by springs 564, 565, 566. Incidentally, if the plate cams 464, 465, 466 are cams having a groove instead of the cams shaped like a disk, the springs 564, 565, 566 are needless.

Figure 24:
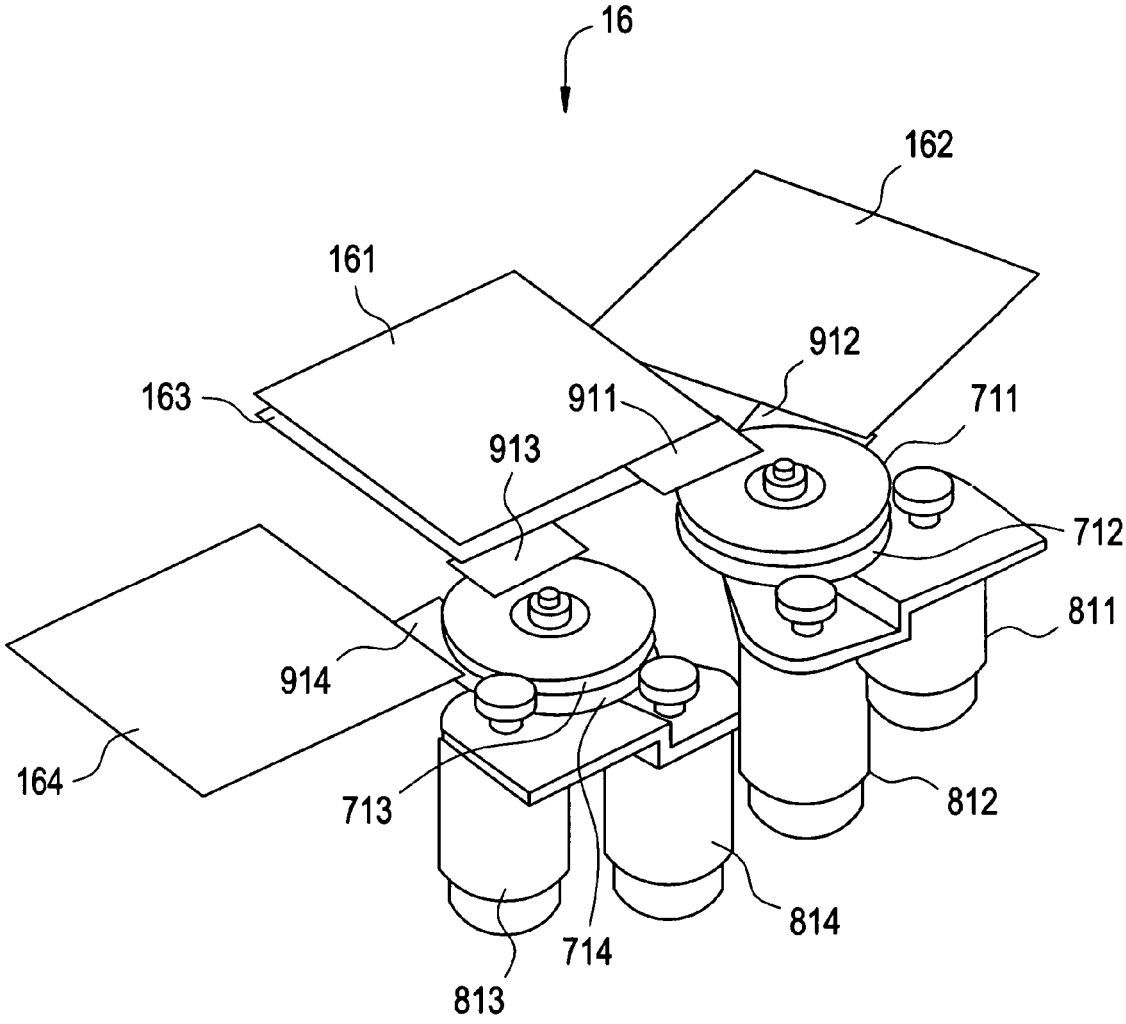
FIG. 24 is a view showing another construction of a filter.

FIG. 24 shows another example of the construction of the filter 16. In this example, filter plates 161, 162, 163 and 164 are driven by motors 811, 812, 813 and 814 via decelerators 711, 712, 713 and 714. The filter plates 161, 162, 163 and 164 are mounted to the output section of each decelerator 711, 712, 713 and 714 via arms 911, 912, 913 and 914.

Each of the filter plates 161 and 162 moves between the retreating position at the right end section and the advancing position at the left end section by the swing movement of each of the arms 911 and 912 with the rotation of the motors 811 and 812. Each of the filter plates 163 and 164 moves between the retreating position at the left end section and the advancing position at the right end section by the swing movement of each of the arms 913 and 914 with the rotation of the motors 813 and 814.

The section composed of the arms 911 to 914, decelerators 711 to 714 and motors 811 to 814 is one example of the adjusting means in the present invention. The section composed of the arms 911 and 912, decelerators 711 and 712 and motors 811 and 812 and the section composed of the arms 913 and 914, decelerators 713 and 714 and motors 813 and 814 are one example of a pair of moving in/out mechanism in the present invention. The moving in/out mechanism has a construction for moving the filter plates in and out by the swing movement of the arms driven by the motors, thereby being capable of facilitating a miniaturization of the mechanism.

Figure 25:
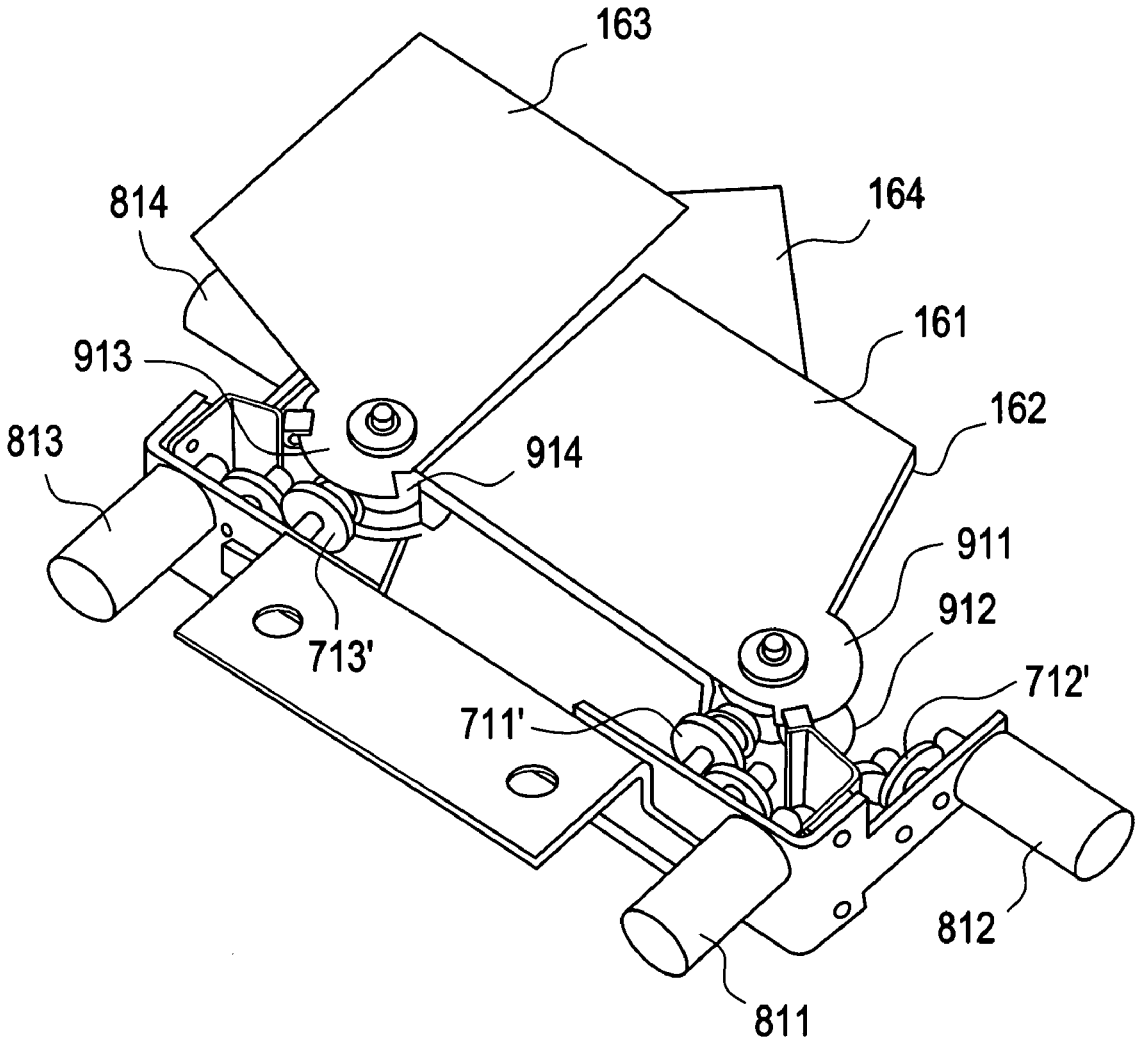
FIG. 25 is a view showing another construction of a filter.

FIG. 25 shows another example of the construction of the filter 16. In this example, filter plates 161, 162, and 163 are driven by motors 811, 812, and 813 via decelerators 711', 712', and 713', respectively. Filter plate 164 is driven by motor 814 via a fourth decelerator (not shown in FIG. 25). The filter plates 161, 162, 163 and 164 are mounted to the output section of each decelerator 711', 712', 713' and the fourth decelerator via arms 911, 912, 913 and 914. The decelerators 711', 712', 713' and the fourth decelerator are configured to change the direction of the rotating axis by 90° on the way. Therefore, the direction of each rotating axis of each of the motors 811, 812, 813 and 814 is horizontal.

Each of the filter plates 161 and 162 moves between the retreating position at the right end section and the advancing position at the left end section by the swing movement of each of the arms 911 and 912 with the rotation of the motors 811 and 812. Each of the filter plates 163 and 164 moves between the retreating position at the left end section and the advancing position at the right end section by the swing movement of each of the arms 913 and 914 with the rotation of the motors 813 and 814.

Figure 26:
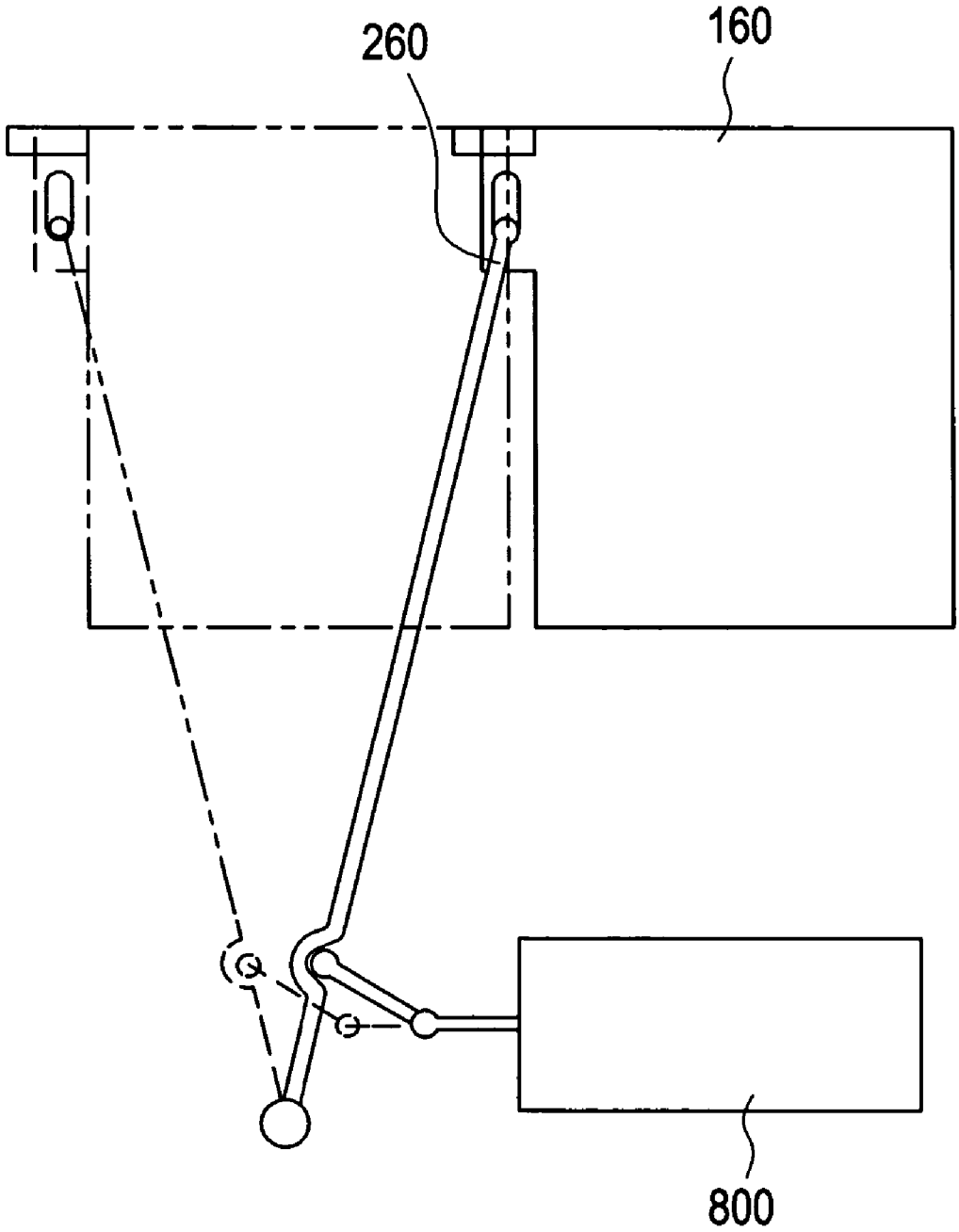
FIG. 26 is a view showing another construction of a filter.

FIG. 26 schematically shows the construction of another example of the filter 16. As shown in the same figure, the filter plate 160 is driven by an actuator 800 via a link 260 so as to move between the retreating position at the left side and the advancing position at the right side. Such mechanism is provided by the number of the filter plates.

An electromagnetic solenoid having a movable section that makes a reciprocating movement is used as the actuator 800. It should be noted that an air cylinder or hydraulic cylinder may be used instead of the electromagnetic solenoid.

The section composed of the link 260 and the actuator 800 is one example of the adjusting means or moving in/out mechanism in the present invention. The moving in/out mechanism moves the filter plate in or out by utilizing the reciprocating movement of the movable section of the electromagnetic solenoid, air cylinder or hydraulic cylinder, thereby facilitating a linear movement.

Many widely different embodiments of the invention may be configured without departing from the spirit and the scope of the present invention. It should be understood that the present invention is not limited to the specific embodiments described in the specification, except as defined in the appended claims.

The invention claimed is:

1. A filter comprising:

more than two plural filter plates that form a layer crossing X-rays, wherein each of said plural filter plates has a constant thickness and the thickness of each filter plate is successively doubled with the thinnest filter plate defined as a reference; and an adjusting device that adjusts a combination of filter plates forming the layer by individually moving the plural filter plates so as to come in and out of an X-ray passing space.

2. A filter according to claim 1, wherein the adjusting device has a pair of moving in/out mechanisms for moving the plural filter plates in and out from both sides of the X-ray passing space, wherein a first of said mechanisms moves a first set of said plural filter plates comprising every other of said plural filter plates, and a second of said mechanisms moves the remaining of said plural filter plates.

3. A filter according to claim 2, wherein the moving in/out mechanisms move the filter plates in and out by a reciprocating movement of a link based upon a rotation of a plate cam.

4. A filter according to claim 3, wherein plural plate cams present at the same side with respect to the X-ray passing space have a common rotation axis.

5. A filter according to claim 2, wherein the moving in/out mechanisms move the filter plates in and out by a swing movement of an arm driven by a motor.

6. A filter according to claim 2, wherein the moving in/out mechanisms move the filter plates in and out by using a reciprocating movement of a movable section of an electromagnetic solenoid.

7. A filter according to claim 2, wherein the moving in/out mechanisms move the filter plates in and out by using a reciprocating movement of a movable section of an air cylinder.

8. A filter according to claim 2, wherein the moving in/out mechanisms move the filter plates in and out by using a reciprocating movement of a movable section of a hydraulic cylinder.

9. An X-ray imaging apparatus for imaging a subject by X-rays via a filter, wherein the filter comprises:

more than two plural filter plates that form a layer crossing X-rays, wherein each of said plural filter plates has a constant thickness and the thickness of each filter plate is successively doubled with the thinnest filter plate defined as a reference; and an adjusting device that adjusts a combination of filter plates forming the layer by individually moving the plural filter plates so as to come in and out of an X-ray passing space.

10. An X-ray imaging apparatus according to claim 9, wherein the adjusting device has a pair of moving in/out mechanisms for moving the plural filter plates in and out from both sides of the X-ray passing space, wherein a first of said mechanisms moves a first set of said plural filter plates comprising every other of said plural filter plates, and a second of said mechanisms moves the remaining of said plural filter plates.

11. An X-ray imaging apparatus according to claim 10, wherein the moving in/out mechanisms move the filter plates in and out by a reciprocating movement of a link based upon a rotation of a plate cam.

12. An X-ray imaging apparatus according to claim 11, wherein plural plate cams present at the same side with respect to the X-ray passing space have a common rotation axis.

13. An X-ray imaging apparatus according to claim 10, wherein the moving in/out mechanisms move the filter plates in and out by a swing movement of an arm driven by a motor.

14. An X-ray imaging apparatus according to claim 10, wherein the moving in/out mechanisms move the filter plates in and out by using a reciprocating movement of a movable section of an electromagnetic solenoid.

15. An X-ray imaging apparatus according to claim 10, wherein the moving in/out mechanisms move the filter plates in and out by using a reciprocating movement of a movable section of an air cylinder.

16. An X-ray imaging apparatus according to claim 10, wherein the moving in/out mechanisms move the filter plates in and out by using a reciprocating movement of a movable section of a hydraulic cylinder.

17. A filter comprising:

plural filter plates that form a layer crossing X-rays, wherein each of said plural filter plates has a constant thickness; and an adjusting device that adjusts a combination of filter plates forming the layer by individually moving the plural filter plates so as to come in and out of an X-ray passing space, the adjusting device having a pair of moving in/out mechanisms for moving the plural filter plates in and out from both sides of the X-ray passing space, wherein a first of said mechanisms moves a first set of said plural filter plates comprising every other of said plural filter plates, and a second of said mechanisms moves the remaining of said plural filter plates.

* * * * *